US006929493B2

(12) United States Patent
Hall et al.

(10) Patent No.: US 6,929,493 B2
(45) Date of Patent: Aug. 16, 2005

(54) ELECTRICAL CONTACT FOR DOWNHOLE DRILLING NETWORKS

(75) Inventors: David R. Hall, Provo, UT (US); H. Tracy Hall, Jr., Provo, UT (US); David S. Pixton, Lehi, UT (US); Scott Dahlgren, Provo, UT (US); Joe Fox, Spanish Fork, UT (US); Cameron Sneddon, Provo, UT (US)

(73) Assignee: IntelliServ, Inc., Provo, UT (US)

( * ) Notice: Subject to any disclaimer, the term of this patent is extended or adjusted under 35 U.S.C. 154(b) by 76 days.

(21) Appl. No.: 10/605,493

(22) Filed: Oct. 2, 2003

(65) Prior Publication Data

US 2005/0074988 A1 Apr. 7, 2005

Related U.S. Application Data

(63) Continuation-in-part of application No. 10/612,255, filed on Jul. 2, 2003, which is a continuation-in-part of application No. 10/453,076, filed on Jun. 3, 2003, and a continuation-in-part of application No. 10/430,734, filed on May 6, 2003.

(51) Int. Cl.[7] ..... H01R 4/60
(52) U.S. Cl. ..... 439/191; 439/592
(58) Field of Search ..... 439/289, 191, 439/192, 194, 195, 592

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |

(Continued)

FOREIGN PATENT DOCUMENTS

| | | |
|---|---|---|
| EP | 0399987 A1 | 11/1990 |
| GB | 2361113 A | 10/2001 |
| WO | W8801096 | 2/1988 |
| WO | WO9014497 | 11/1990 |
| WO | WO 01/21932 A1 | 3/2001 |

OTHER PUBLICATIONS

USPTO Office Action for U.S. Appl. No. 10/430,734, filed May 6, 2003; mailed Sep. 21, 2004.

*Primary Examiner*—Tho D. Ta
(74) *Attorney, Agent, or Firm*—Jeffery E. Daly

(57) ABSTRACT

An electrical contact system for transmitting information across tool joints while minimizing signal reflections that occur at the tool joints includes a first electrical contact comprising an annular resilient material. An annular conductor is embedded within the annular resilient material and has a surface exposed from the annular resilient material. A second electrical contact is provided that is substantially equal to the first electrical contact. Likewise, the second electrical contact has an annular resilient material and an annular conductor. The two electrical contacts configured to contact one another such that the annular conductors of each come into physical contact. The annular resilient materials of each electrical contact each have dielectric characteristics and dimensions that are adjusted to provide desired impedance to the electrical contacts.

22 Claims, 10 Drawing Sheets

U.S. PATENT DOCUMENTS 2,659,773 A 11/1953 Barney
2,662,123 A 12/1953 Koenig, Jr.
2,748,358 A 5/1956 Johnston
2,974,303 A 3/1961 Dixon
2,982,360 A 5/1961 Morton et al.
3,079,549 A 2/1963 Martin
3,090,031 A 5/1963 Lord
3,170,137 A 2/1965 Brandt
3,186,222 A 6/1965 Martin
3,194,886 A 7/1965 Mason
3,209,323 A 9/1965 Grossman, Jr.
3,227,973 A 1/1966 Gray
3,253,245 A 5/1966 Brandt
3,518,608 A 6/1970 Papadopoulos
3,518,609 A 6/1970 Fontenot, Jr.
3,657,681 A * 4/1972 Falkner ..... 439/205
3,693,133 A * 9/1972 Harbonn et al. ..... 439/278
3,696,332 A 10/1972 Dickson, Jr. et al.
3,731,258 A * 5/1973 Spicer ..... 439/278
3,793,632 A 2/1974 Still
3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 Macleod
4,605,268 A 8/1986 Meador
4,660,910 A 4/1987 Sharp et al.
4,676,563 A 6/1987 Curlett et al.
4,683,944 A 8/1987 Curlett
4,690,212 A * 9/1987 Termohlen ..... 166/65.1
4,698,631 A 10/1987 Kelly, Jr. et al.
4,722,402 A 2/1988 Weldon
4,785,247 A 11/1988 Meador et al.
4,788,544 A 11/1988 Howard
4,799,544 A 1/1989 Curlett
4,806,928 A 2/1989 Veneruso
4,884,071 A 11/1989 Howard
4,901,069 A 2/1990 Veneruso
4,913,657 A * 4/1990 Naito et al. ..... 439/192
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,223,826 B1 5/2001 Chau et al.
6,367,564 B1 4/2002 Mills et al.
6,367,565 B1 4/2002 Hall
6,392,317 B1 5/2002 Hall et al.
6,405,795 B2 6/2002 Holbert et al.
6,641,434 B2 11/2003 Boyle et al.
6,655,464 B2 12/2003 Chau et al.
6,670,880 B1 12/2003 Hall et al.
6,688,396 B2 * 2/2004 Floerke et al. ..... 166/380
2002/0135179 A1 9/2002 Boyle et al.
2002/0193004 A1 12/2002 Boyle et al.
2003/0070842 A1 4/2003 Bailey et al.
2003/0213598 A1 11/2003 Hughes

* cited by examiner 10a
12a
16a
22a
14a
14b
22b
16b
12b
10b 10a
12a
16a
14a
14b
16b
12b
10b 10a
45
12a
16a
40a
44
40b
16b
12b
45
14a
14b
42
10b

ELECTRICAL CONTACT FOR DOWNHOLE DRILLING NETWORKS

CROSS-REFERENCE TO RELATED APPLICATIONS

This application is a continuation-in-part of U.S. patent application Ser. No. 10/430,734 "Loaded Transducer for Downhole Drilling Components" filed on May 6, 2003 and is also a continuation-in-part of U.S. patent application Ser. No. 10/612,255 "Transmission Element for Downhole Drilling Components" filed on Jul. 2, 2003, which is a continuation-in-part of U.S. patent application Ser. No. 10/453,076 entitled "Improved Transducer for Downhole Drilling Components" filed on Jun. 3, 2003. All the above applications incorporated by reference herein for all they contain.

STATEMENT OF GOVERNMENT INTEREST

This invention was made with government support under Contract No. DE-FC26-01NT41229 awarded by the U.S. Department of Energy. The government has certain rights in the invention.

BACKGROUND OF INVENTION

1. Field of the Invention

This invention relates to oil and gas drilling, and more particularly to apparatus and methods for reliably transmitting information between downhole drilling components.

2. Background of the Invention

In the downhole drilling industry, MWD and LWD tools are used to take measurements and gather information concerning downhole geological formations, status of downhole tools, and other conditions located downhole. Such data is useful to drill operators, geologists, engineers, and other personnel located at the surface. This data may be used to adjust drilling parameters, such as drilling direction, penetration speed, and the like, to effectively tap into an oil or gas bearing reservoir. Data may be gathered at various points along the drill string, such as from a bottom hole assembly or from sensors distributed along the drill string.

Nevertheless, data gathering and analysis represent only certain aspects of the overall process. Once gathered, apparatus and methods are needed to rapidly and reliably transmit the data to the earth's surface. Traditionally, technologies such as mud pulse telemetry have been used to transmit data to the surface. However, most traditional methods are limited to very slow data rates and are inadequate for transmitting large quantities of data at high speeds.

In order to overcome these limitations, various efforts have been made to transmit data along electrical and other types of cable integrated directly into drill string components, such as sections of drill pipe. In such systems, electrical contacts or other transmission elements are used to transmit data across tool joints or connection points in the drill string. Nevertheless, many of these efforts have been largely abandoned or frustrated due to unreliability and complexity.

For example, drill strings may include hundreds of sections of drill pipe and other downhole tools connected in series. In order to reach the surface, data must be transmitted reliably across each tool joint. A single faulty connection may break the link between downhole sensors and the surface. Also, because of the inherent linear structure of a drill string, it is very difficult to build redundancy into the system.

The unreliability of various known contact systems is due to several factors. First, since the tool joints are typically screwed together, each of the tools rotate with respect to one another. This causes the contacts to rotate with respect to one another, causing wear, damage, and possible misalignment. In addition, as the tool joints are threaded together, mating surfaces of the downhole tools, such as the primary and secondary shoulders, come into contact. Since downhole tools are not typically manufactured with precise tolerances that may be required by electrical contacts, this may cause inconsistent contact between the contacts.

Moreover, the treatment and handling of drill string components is often harsh. For example, as sections of drill pipe or other tools are connected together, ends of the drill pipe may strike or contact other objects. Thus, delicate contacts or transmission elements located at the tool ends can be easily damaged. In addition, substances such as drilling fluids, mud, sand, dirt, rocks, lubricants, or other substances may be present at or between the tool joints. This may degrade connectivity at the tools joints. Moreover, the transmission elements may be subjected to these conditions each time downhole tools are connected and disconnected.

Thus, what are needed are reliable contacts for transmitting data across tool joints that are capable of overcoming the previously mentioned challenges.

What are further needed are reliable contacts that are resistant to wear and tear encountered in a downhole environment.

What are further needed are reliable contacts that, even when damaged, still provide reliable connectivity.

What are further needed are apparatus and method to adjust the impedance of the contacts to minimize signal reflections at the tool joints.

SUMMARY OF INVENTION

In view of the foregoing, it is a primary object of the present invention to provide apparatus and methods for reliably transmitting information between downhole tools in a drill string. It is a further object of the invention to provide robust electrical connections that may withstand the rigors of a downhole environment. It is yet another object of the invention to provide apparatus and methods to reduce signal reflections that may occur at the tool joints.

Consistent with the foregoing objects, and in accordance with the invention as embodied and broadly described herein, an electrical contact system for transmitting information across tool joints, while minimizing signal reflections that occur at the tool joints, is disclosed in one embodiment of the invention as including a first electrical contact comprised of an annular resilient material. An annular conductor is embedded within the annular resilient material and has a surface exposed from the annular resilient material.

A second electrical contact is provided that is substantially equal to the first electrical contact. Likewise, the second electrical contact has an annular resilient material and an annular conductor. The two electrical contacts configured to contact one another such that the annular conductors of each come into physical contact. The annular resilient materials of each electrical contact each have dielectric characteristics and dimensions that are adjusted to provide desired impedance to the electrical contacts.

In selected embodiments, the first and second electrical contacts further include first and second annular housings, respectively, to accommodate the annular resilient materials, and the annular conductors, respectively. In certain embodiments, the electrical contact system includes one or several biasing member to urge each of the electrical contacts together. For example, the biasing member may be a spring, an elastomeric material, an elastomeric-like material, a sponge, a sponge-like material, or the like. In other embodiments, one or both of the annular housings are sprung with respect to corresponding mating surfaces of downhole tool in which they are mounted. This may provide a biasing effect to one or both of the electrical contacts.

In selected embodiments, the first and second electrical contacts are configured such that pressure encountered in a downhole environment presses them more firmly together. In other embodiments, one or both of the electrical contacts are configured to "orbit" with respect to a mating surface of a downhole tool. By "orbiting," it is meant that the electrical contacts may pivot along multiple axes to provide improved contact.

In certain embodiments, the annular resilient materials are constructed of a material selected to flow into voids that may or may not be present within the electrical contacts. In selected embodiments, the annular resilient material may be constructed of a material such as silicone, Vamac, polysulfide, Neoprene, Hypalon, butyl, Teflon, millable or cast polyurethane, rubber, fluorosilicone, epichlorohydrin, nitrile, styrene butadiene, Kalrez, fluorocarbon, Chemraz, Aflas, other polymers, and the like. To provide strength, durability, or other characteristics, modifiers such as Kevlar, fibers, graphite, or like materials, may be added to the annular resilient material.

In selected embodiments, a cable is electrically connected to one or both of the electrical contracts, and the impedance of one or both of the electrical contacts is adjusted to match the impedance of the cable. In certain embodiments, the cable is a coaxial cable. In other embodiments, multiple annular conductors may be embedded in the annular resilient material to provide multiple connections.

In another aspect of the present invention, a method for transmitting information across tool joints in a drill string, while minimizing signal reflections occurring at the tool joints, may include providing a first electrical contact comprised of an annular resilient material, and an annular conductor embedded within the first annular resilient material. The annular conductor has a surface exposed from the annular resilient material. The method may further include providing a corresponding electrical contact substantially equal to the first electrical contact. The corresponding electrical contact also includes an annular resilient material and a second annular conductor. The method further includes adjusting the dielectric characteristics, the dimensions, or both of the annular resilient materials to provide desired impedance to the electrical contacts.

In selected embodiments, the method may further include providing annular housings to the electrical contacts, respectively, to accommodate the annular resilient materials, and the annular conductors. In certain embodiments, a method in accordance with the invention includes urging the electrical contacts together. Likewise, adjusting may include adjusting the impedance to match the impedance of a cable electrically connected to at least one of the first and second electrical contracts. In certain embodiments, the cable is a coaxial cable.

BRIEF DESCRIPTION OF DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings.

DETAILED DESCRIPTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
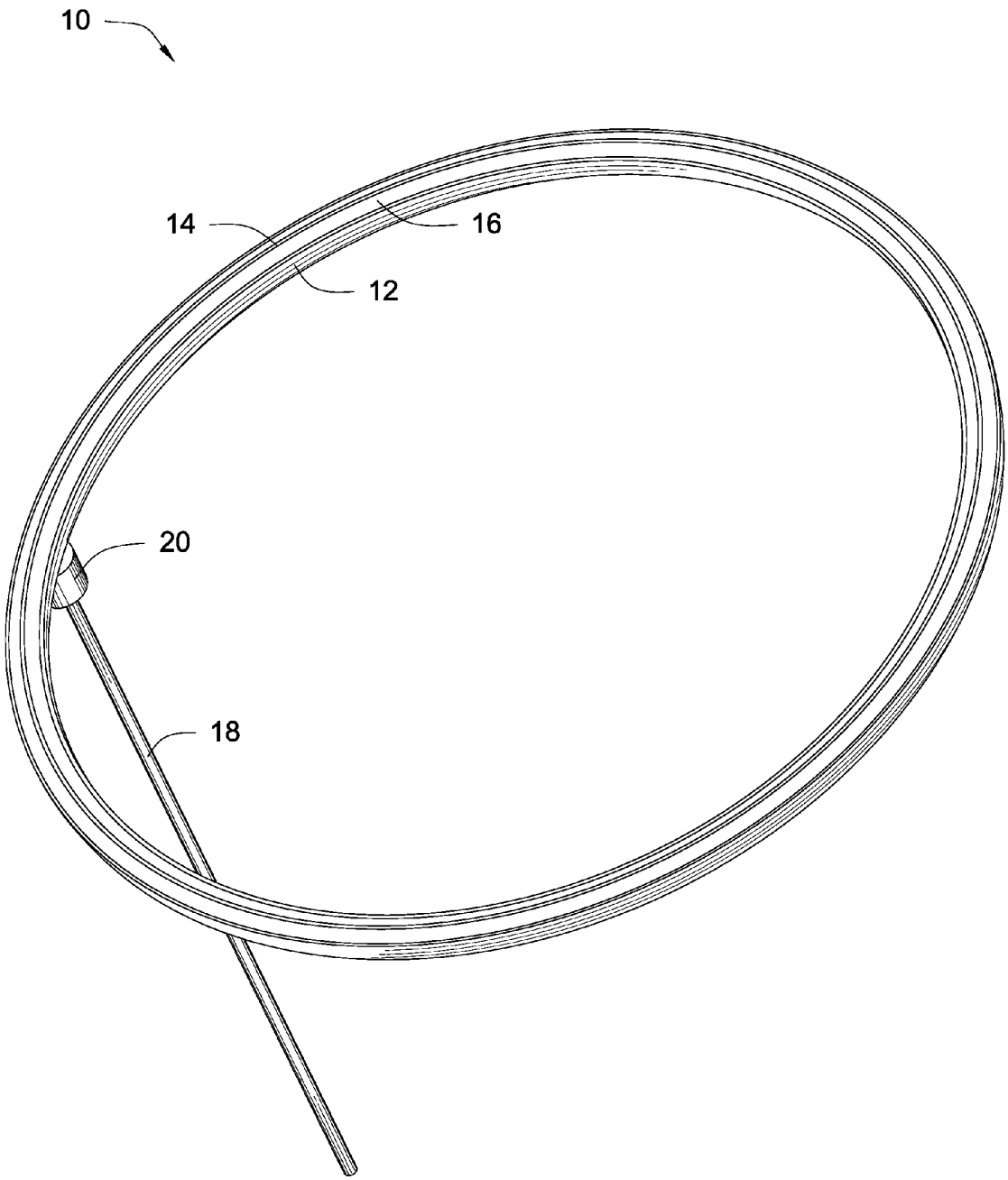
FIG. 1 is a perspective view illustrating one embodiment of an electrical contact assembly in accordance with the invention.

Referring to FIG. 1, a contact assembly 10 in accordance with the invention may be characterized by a substantially annular shape. This annular shape may enable the contact assembly 10 to be installed in the box end or pin end of a downhole tool (not shown). For example, the contact assembly 10 may be installed in an annular recess milled into the primary or secondary shoulder of a downhole tool (not shown).

In selected embodiments, a contact assembly 10 may include an annular housing 12 and a resilient material 16 located within the housing 12. An annular contact 14 may be embedded into the resilient material and may have a surface exposed from the resilient material 16. The resilient material 16 may serve to insulate the annular conductor 14 from the housing 12 as well as perform other functions described in this specification. In selected embodiments, a cable 18 may include a conductor connected to the annular contact 14. In certain embodiments, the contact assembly 10 may include an alignment and retention member 20 that may fit within a corresponding recess milled or formed into the downhole tool. The retention member 20 may be used to retain a desired tension in the cable 18.

Figure 2:
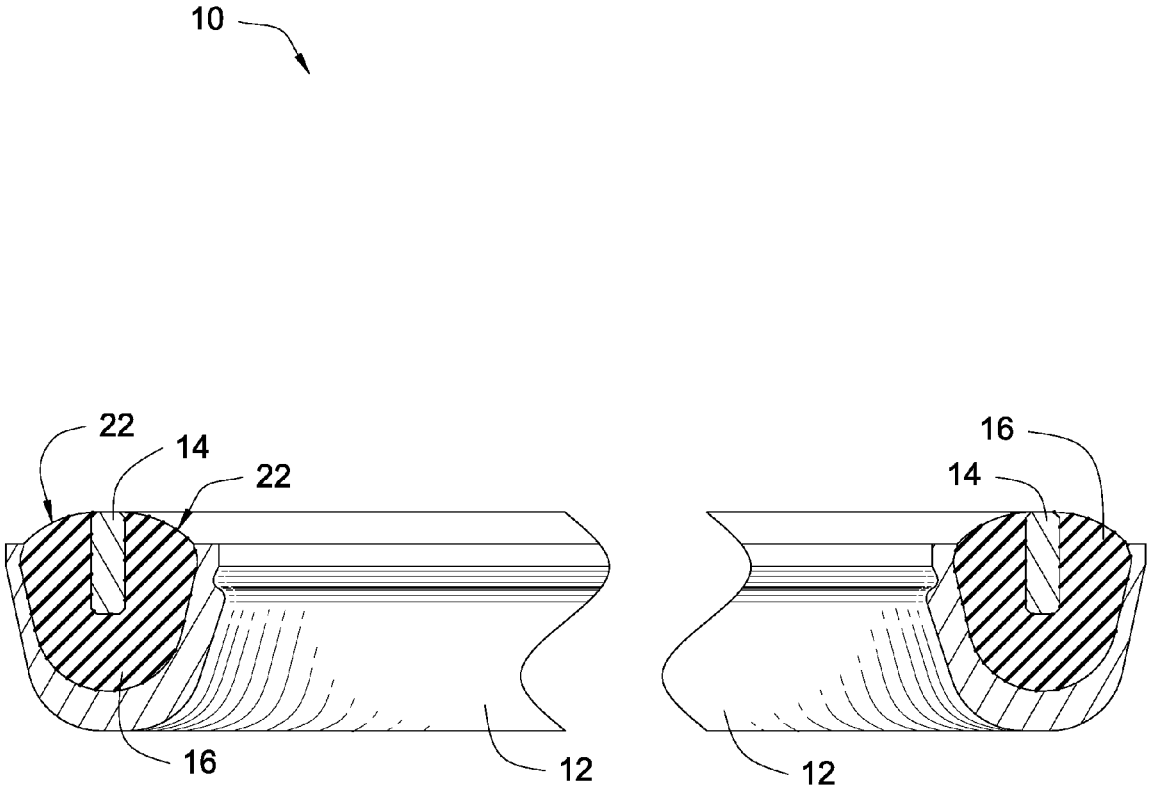
FIG. 2 is a perspective cross-sectional view of the electrical contact assembly illustrated in FIG. 1.

Referring to FIG. 2, a cross-sectional view of the contact assembly 10 of FIG. 1 is illustrated. As is illustrated, a housing 12 may be used to accommodate a resilient material 16 and a conductor 14 embedded within the resilient material. In certain embodiments, the conductor 16 may have a substantially rectangular or elongated cross-section to provide substantial surface area between the conductor 14 and the resilient material 16 to provide sufficient adhesion therebetween. Nevertheless, the conductor 14 may have any of numerous cross-sectional shapes, as desired. In selected embodiments, the resilient material 16 may have a rounded or curved contour 22 such that the resilient material 16 and conductor 14 reside above the housing 12.

Figure 3:
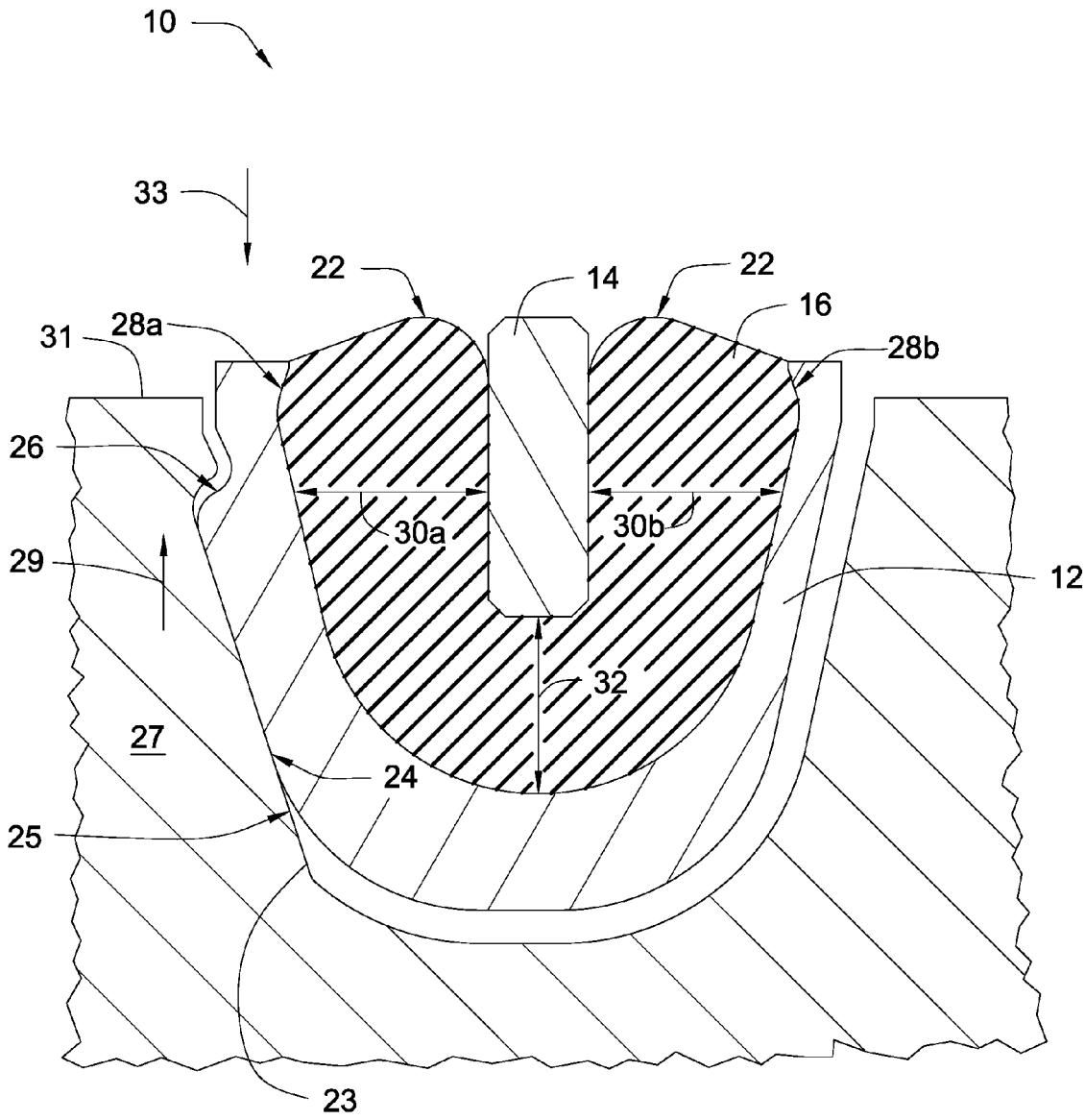
FIG. 3 is a cross-sectional view illustrating one embodiment of the internal components of the electrical contract assembly of FIG. 1.

Referring to FIG. 3, an enlarged cross-sectional view of the contact assembly 10 is illustrated. As shown, the housing 12 may include an angled surface 24. The contact assembly 10 may sit in a recess 23 milled or formed in the primary or secondary shoulder 27 of a downhole tool 27. The recess 23 may include a corresponding angled surface 25. By manufacturing the housing 12 such that it has a radius slightly smaller than the radius of the recess 23, the angled surfaces 24, 25 may exert force against one another such that the contact assembly 10 is urged in a direction 29. That is, the angled surfaces 24, 25 may create a spring-like force urging the housing 12 in the direction 29. Likewise, when a force 33 is exerted on the contact assembly 10, the contact assembly 10 may be urged down into the recess 23. In selected embodiments, the contact assembly 10 may "orbit" with respect to a mating surface 27. That is, due to the biasing effect of the surfaces 24, 25, the annular contact 10 may move with respect to the mating surface 27 similar to a universal joint. This may provide better and more consistent contact between contact assemblies 10.

As illustrated, the housing 12 may include a shoulder 26 that may engage a corresponding shoulder milled or formed into the recess 23. This may enable the contact assembly 10 to be pressed into the recess 23. Once inserted, the shoulder 26 may prevent the contact assembly 10 from exiting the recess 23. Likewise, the housing 12 may optionally include one or several retaining shoulder 28*a*, 28*b* to help retain the resilient material 16 within the housing 12.

As was previously mentioned with respect to FIG. 1, the conductor 14 may be connected to a cable 18. In selected embodiments, the cable 18 may be a coaxial cable 18. As is typical of most coaxial cables 18, or other cables 18 for that matter, each usually has a rated impedance. In coaxial cable 18, the impedance is usually a function of the diameter of the cable 18, the diameter of the core conductor, and the diameter and dielectric constant of a dielectric material surrounding the core conductor. In order to minimize signal reflections, it is important to match as accurately as possible the impedance of the contact assembly 10 to the impedance of the coaxial or other cable 18.

Thus, in selected embodiments, the impedance of the contact assembly 10 may be adjusted to match a particular coaxial cable 18 being used. In certain embodiments, the contact assembly 10 may more or less resemble coaxial cable. For example, the conductor 14 may be analogous to the core conduct of coaxial cable, the housing 12 may be analogous to the coaxial shield, and the resilient material 16 may be analogous to the dielectric material within the coaxial cable 18. By adjusting the dimensions 30*a*, 30*b*, 32 of the resilient material 16, and the dielectric properties of the resilient material 16, the impedance of the contact assembly 10 may be adjusted to provide a desired impedance. Thus, signal reflections occurring at the contact assemblies 10 may be minimized as much as possible.

The resilient material 16 may be constructed of any suitable material capable of withstanding a downhole environment. For example, in certain embodiments, the resilient material 16 may be constructed of a material such as silicone, Vamac, polysulfide, Neoprene, Hypalon, butyl, Teflon, millable or cast polyurethane, rubber, fluorosilicone, epichlorohydrin, nitrile, styrene butadiene, Kalrez, fluorocarbon, Chemraz, Aflas, other polymers, and the like. To provide strength, durability, or other characteristics, modifiers such as Kevlar, fibers, graphite, or like materials, may be added to the annular resilient materials 16.

Figure 4:
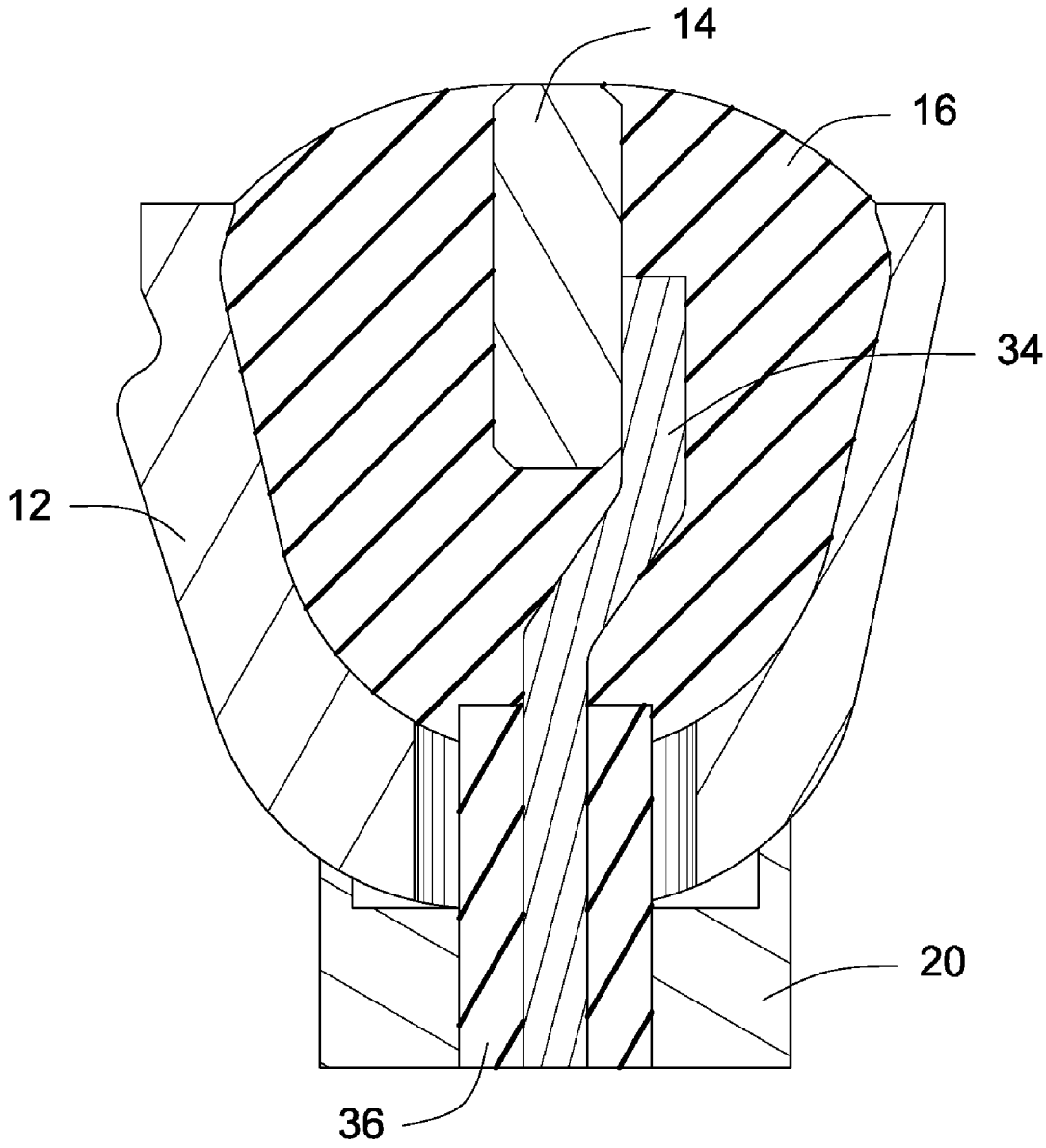
FIG. 4 is a cross-sectional view illustrating one embodiment of a connection point between the annular contact and a conductive cable.

Referring to FIG. 4, as was previously mentioned with respect to FIG. 1, the annular contact 14 might be connected to a cable 18, such as a coaxial cable 18. As is illustrated, a conductor 34 may extend through the housing 12 and the resilient material 16 to connect to the annular conductor 14. The connection may be made by soldering, welding, or any other suitable method to produce a strong, conductive bond. As illustrated, a sheath 36, such as an insulator or coaxial sheathing, may protect and insulate the conductor 34.

Figures 5A, 5B, 5C:
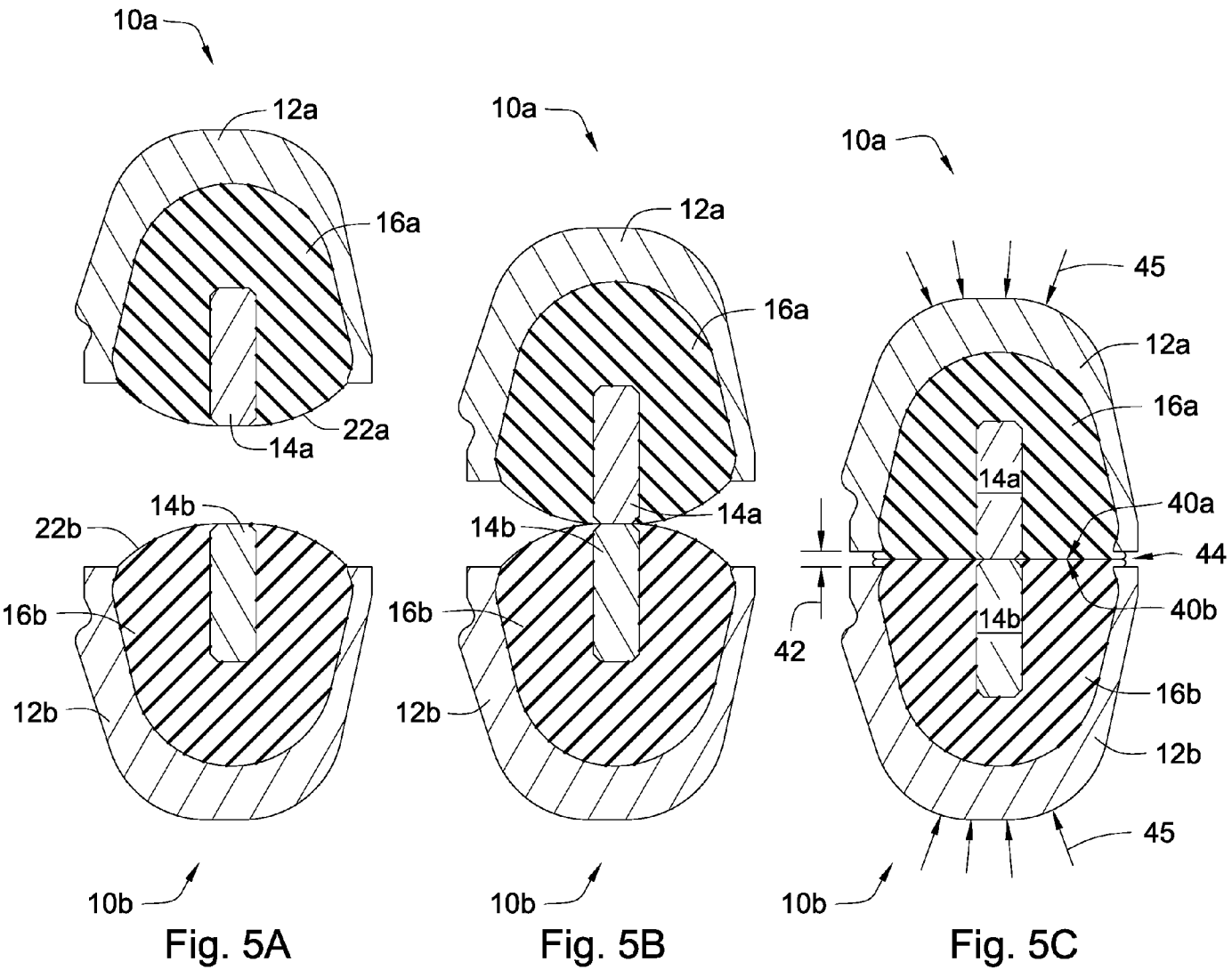
FIGS. 5A–5C are various cross-sectional views illustrating the mating relationship between two electrical contact assemblies in accordance with the invention.

Referring to FIGS. 5A–5C, two contact assemblies 10*a*, 10*b* are illustrated transitioning from a separated to a connected state. In FIG. 5A, when the contact assemblies 10*a*, 10*b* are separated, the resilient material 16*a*, 16*b* may have a rounded or protruding surface 22*a*, 22*b*. In selected embodiments, the resilient material 16*a*, 16*b* may protrude out more than the contacts 14*a*, 14*b* such that the surfaces 22*a*, 22*b* meet before the contacts 14*a*, 14*b*. This may provide a seal to isolate the contacts 14*a*, 14*b* from the surrounding environment. Since the contacts 14*a*, 14*b* may electrically arc when they near each other, isolating the contacts 14*a*, 14*b* may help prevent this arcing from igniting gases or other flammable substances that may be present in a downhole drilling environment. Nevertheless, in other embodiments, the contacts 14*a*, 14*b* may actually be flush with or protrude out farther than the resilient materials 16*a*, 16*b*.

Referring to FIG. 5B, as the contact assemblies 10*a*, 10*b* near one another, the contacts 14*a*, 14*b* may meet. As this occurs, the resilient materials 16*a*, 16*b* may begin to compress into the housings 12*a*, 12*b*. Due to their resiliency, the resilient materials 16*a*, 16*b* may provide a spring like force urging the contacts 14*a*, 14*b* together.

Referring to FIG. 5C, in selected embodiments, as the resilient materials 16*a*, 16*b* continue to compress into the housings 12*a*, 12*b*, they may flatten to form more planar surfaces 40*a*, 40*b*. Likewise, the increased compression keeps the contacts 14*a*, 14*b* more firmly pressed together. In selected embodiments, the resilient materials 16*a*, 16*b* may actually protrude or be squeezed slightly from the housings 12*a*, 12*b* at a point 44. In other embodiments, even when the contact assemblies 10*a*, 10*b* are fully pressed together, a gap 42 may still be present between the housings 12*a*, 12*b*. Thus, the resilient materials 16*a*, 16*b* may continue to exert force on the contacts 14*a*, 14*b* without having this energy absorbed by contact of the housings 12*a*, 12*b*.

In selected embodiments, three "energizing" elements may contribute to keep the contacts 14*a*, 14*b* firmly pressed together. First, as was previously mentioned with respect to FIG. 3, the housings 12*a*, 12*b* may be spring-loaded with respect to their respective recesses 23, thereby urging the contact assemblies 10*a*, 10*b* together. Second, the resilient materials 16*a*, 16*b* may provide a spring-like force urging the contacts 14*a*, 14*b* together. Lastly, high-pressure levels 45 often present downhole may exert a force on the housings 12*a*, 12*b*, keeping the contact assemblies 10*a*, 10*b* firmly pressed together. Any or all of these "energizing" forces may be used to provide more reliable contact between the contacts 14*a*, 14*b*.

Figures 6A, 6B, 6C:
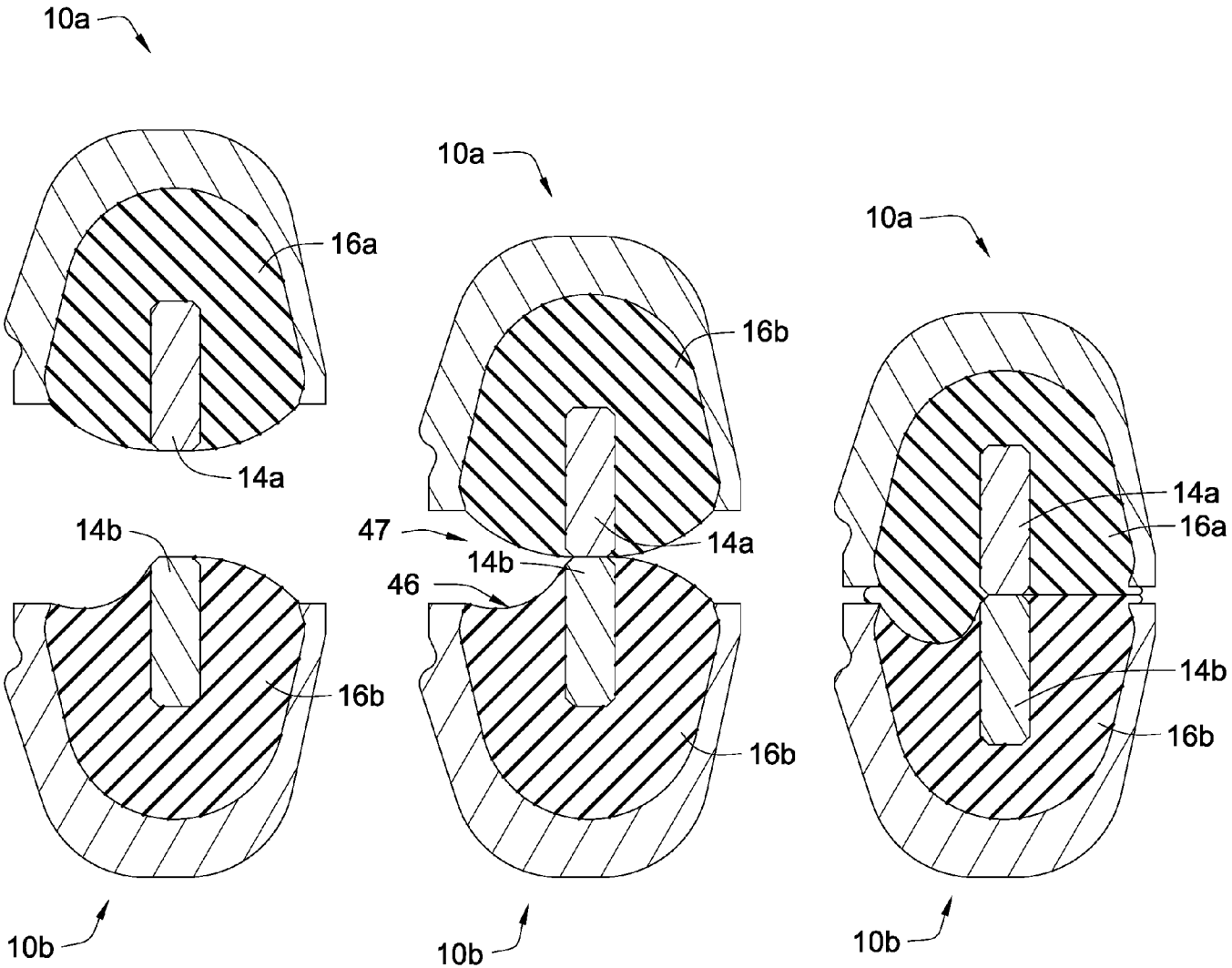
FIGS. 6A–6C are various cross-sectional views illustrating one embodiment of the mating relationship between two electrical contact assemblies when a void or damaged area exists in one of the assemblies.

Referring to FIGS. 6A–6C, two damaged or asymmetrical contact assemblies 10*a*, 10*b* are illustrated transitioning from a separated to a connected state. As was previously mentioned, downhole tools may be subjected to hostile environments downhole. Moreover, this harsh treatment may also occur at the surface as tool sections are connected and disconnected. This provides ample opportunity for the contact assemblies to be damaged, worn, and the like. Since the reliability of contact assemblies is very important, their ability to withstand damage or wear is a desired attribute.

Referring to FIG. 6A, in certain instances, damage or other events may create a void 46 or damaged area 46 in the resilient material 16*b*. For example, when the pin and box end of downhole tools are threaded together, the contact assemblies 10*a*, 10*b* may rub against one another. Dirt, rocks, or other substances may become interposed between the surfaces of the contact assemblies 10. This may cause abrasion or wear that may remove a portion of the resilient material 16*b*, thereby creating the void 46. Other conditions, such as striking the ends of drill tools, downhole pressure, and the like, may also cause damage to the contact assemblies 10*a*, 10*b*.

Referring to FIG. 6B, as the contact assemblies 10*a*, 10*b* come together, the void may create an undesirable gap 47 between the resilient materials 16*a*, 16*b*. This may cause undesired exposure of the contacts 14*a*, 14*b*, possibly causing shorting, corrosion, arcing, or the like.

Referring to FIG. 6C, nevertheless, by proper selection of resilient materials 16*a*, 16*b* such as those listed with respect to FIG. 3, the contact assemblies 10*a*, 10*b* may compensate for voids or damage that may be present in the resilient material 16*b*. For example, when the contact assemblies 10*a*, 10*b* are pressed together, the resilient material 16*a* from one contact assembly 10*a* may flow into the void 46 of the other resilient material 16*b*. Thus, even when damage is present, the resilient materials 16*a*, 16*b* may conform to one another, provide a spring-like bias to the contacts 14*a*, 14*b*, and seal out potential contaminants.

Figure 7:
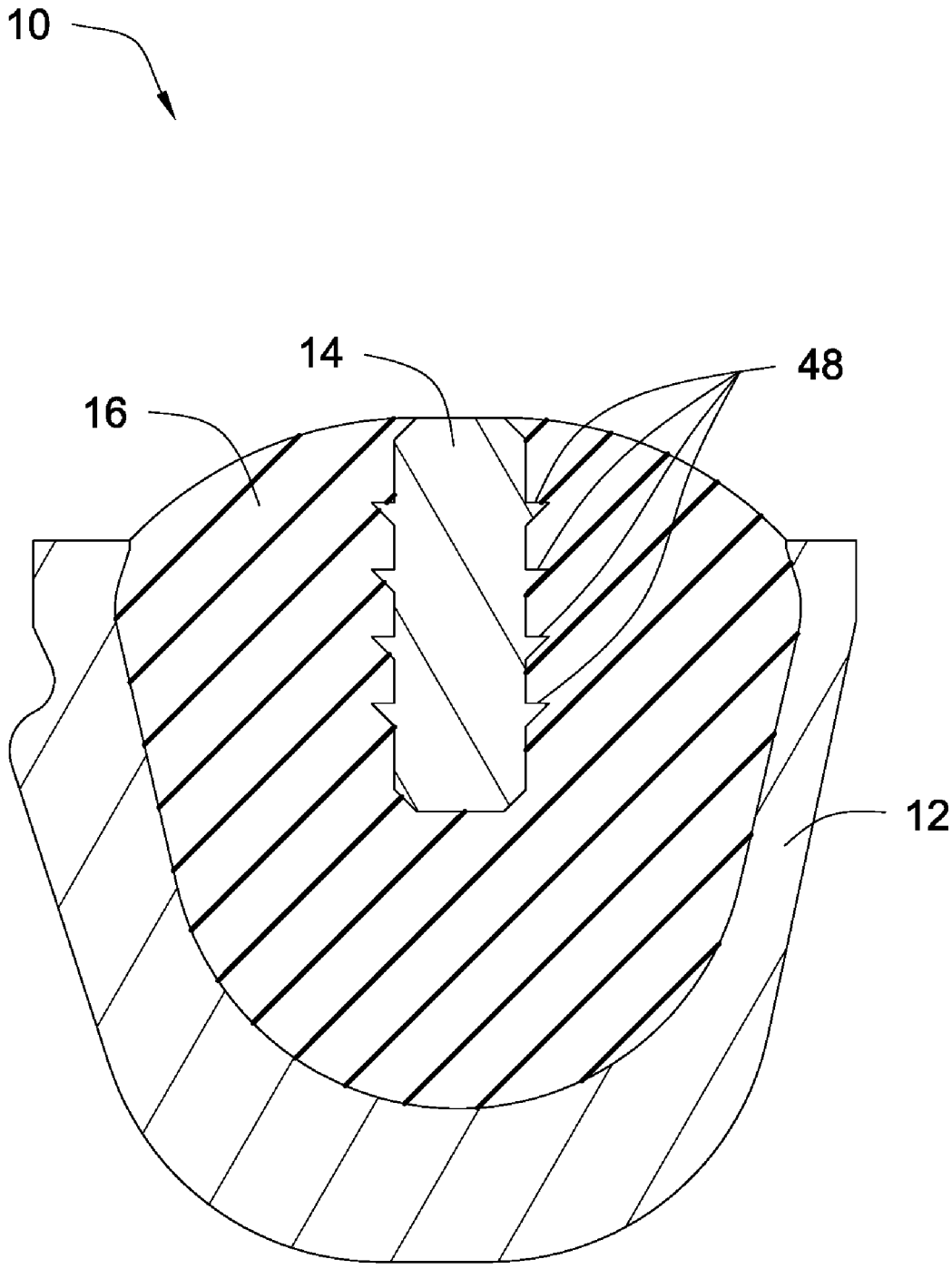
FIG. 7 is a cross-sectional view illustrating one embodiment of various gripping features that may be integrated into the annular contact.

Referring to FIG. 7, in selected embodiments, the contact 14 may be shaped or textured to include gripping features 48. For example, the gripping features 48 may be barbs, or may simply be surface textures created by sanding or otherwise roughening the surface of the contact 14. Since, the resilient material 16 may be compressed when contacting another contact assembly 10, the contact 14 may tend to separate from the resilient material 16. Thus, the gripping features 48 may provide improved adhesion between the resilient material 16 and the contact 14. Likewise, although not illustrated, the inside of the housing 12 may be textured or have other surface features to provide improved adhesion between the resilient material 16 and the housing 12.

Figure 8:
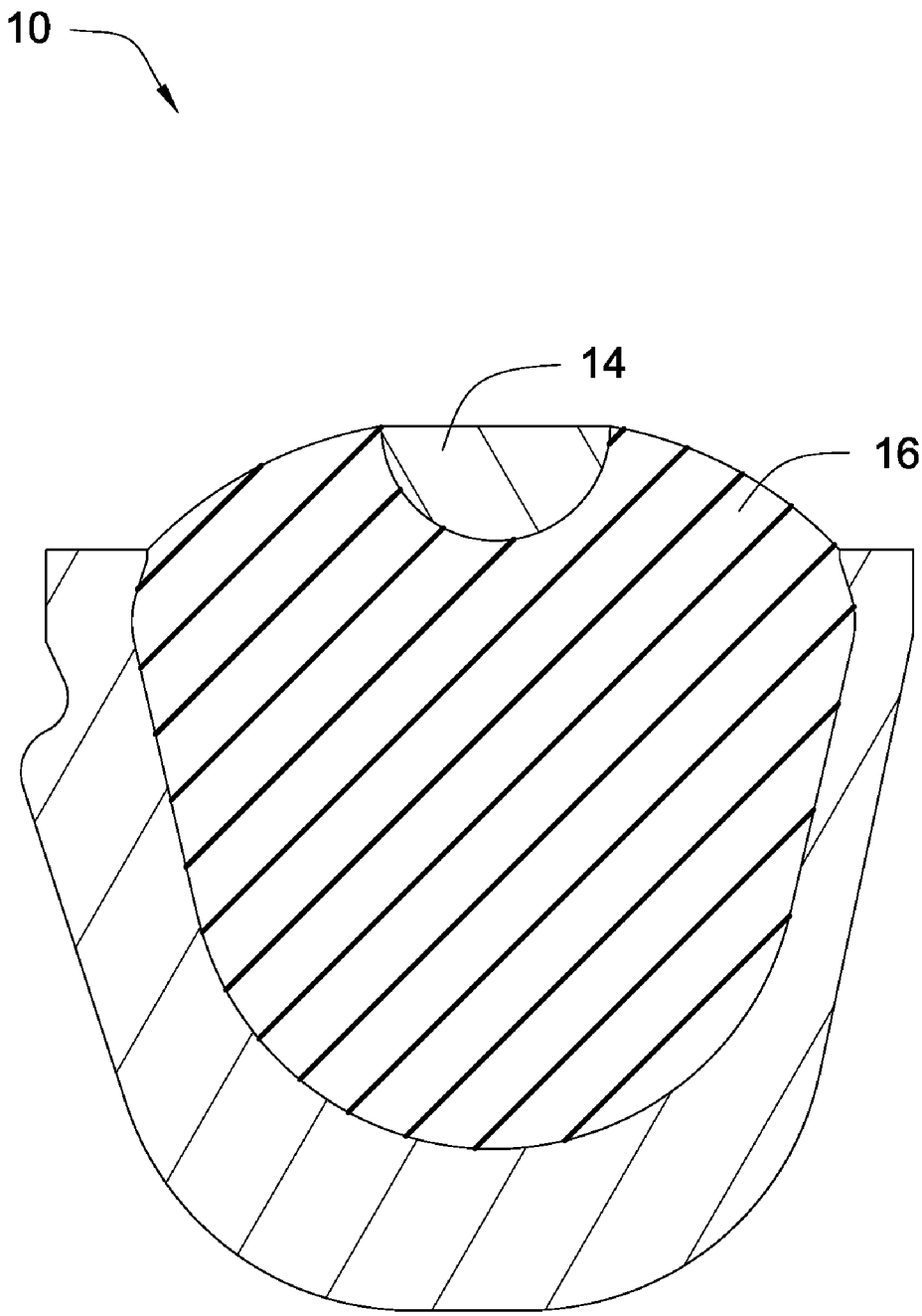
FIG. 8 is a cross-sectional view illustrating one embodiment of an annular contact that resembles the core of a traditional coaxial cable.

Referring to FIG. 8, in selected embodiments, the contact 14 may resemble a half cylinder or a shape similar thereto. Thus, when two contact assemblies 10 come together, the contact 14 may form a substantially cylindrical core 14. Thus, the contact assemblies 10 may more closely resemble a typical coaxial cable having a cylindrical core. This may provide improved matching with a coaxial cable, thereby reducing signal reflections.

Figure 9:
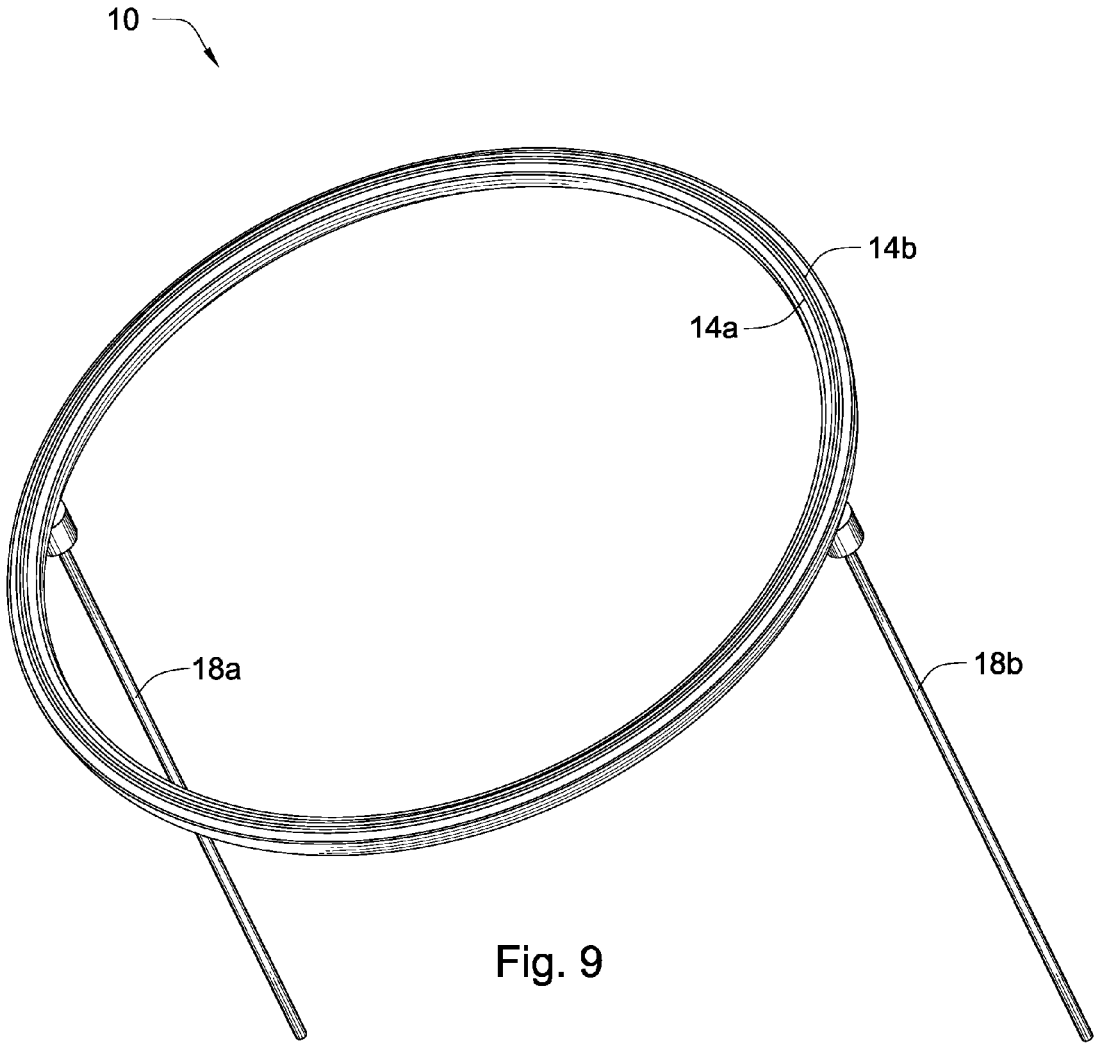
FIG. 9 is a perspective view illustrating one embodiment of an electrical contact assembly in accordance with the invention having multiple annular contacts.

Referring to FIG. 9, in other embodiments, multiple annular conductors 14*a*, 14*b* may be provided in a contact assembly 10. For example, in selected embodiments, one conductor 14*a* may provide a downhole link, and a second conductor 14*b* may provide an uphole link. Or in other embodiments, one conductor 14*a* may be used to carry data and the other 14*b* power. In other embodiments, more than two conductors 14 may be used to carry, data, power, or a combination thereof.

Figure 10:
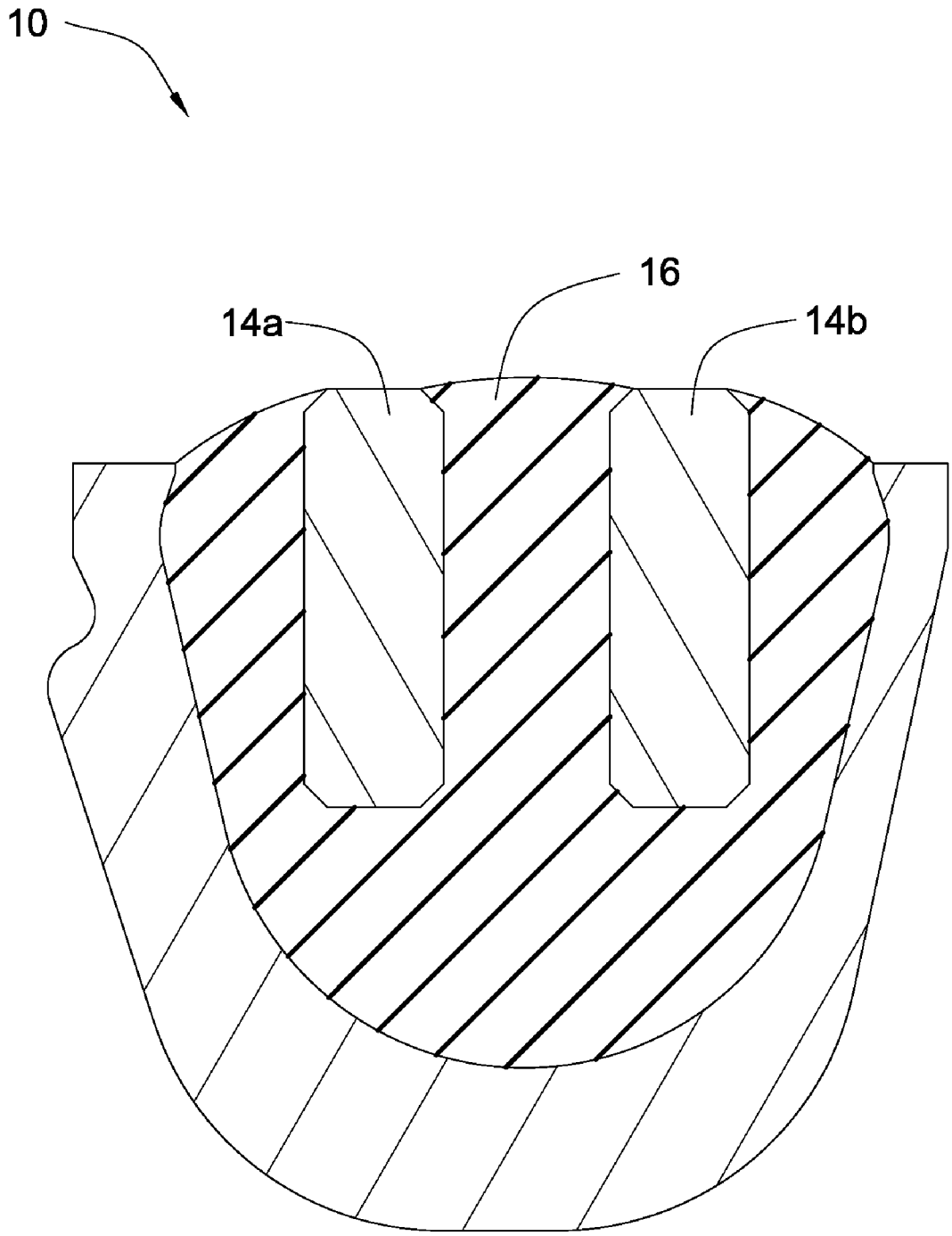
FIG. 10 is a cross-sectional view of the electrical contact assembly illustrated in FIG. 9.

Referring to FIG. 10, a cross-sectional view of the contact assembly 10 of FIG. 9 is illustrated. As shown, two or more conductors 14*a*, 14*b* may be embedded within the resilient material 16 and may be separated by an appropriate distance to prevent shorting or crosstalk.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. An electrical contact system for transmitting information across tool joints in a drill string, the electrical contact system comprising:

a first electrical contact comprising:

a first annular resilient material;

a first annular conductor embedded within the first annular resilient material, the first annular conductor having a surface exposed from the first annular resilient material;

a first housing to accommodate the first resilient material and the first conductor; the first housing disposed within a recess adjacent an end of the tool joint and having an angled surface interacting with a corresponding angled surface in the recess to exert a force urging the first contact outward from the recess;

a second electrical contact having a second annular resilient material and a second annular conductor embedded within the second annular resilient material, and a second housing to accommodate the second resilient material;

the second contact mounted adjacent an end of a mating tool joint;

wherein, upon assembly of the tool joints, the first and second contacts connect and are held engaged by the force.

2. The electrical contact system of claim 1, wherein the resilient material is selected such that it flows into voids present in the first and second electrical contacts.

3. The electrical contact system of claim 1, further comprising a third annular conductor embedded in the first annular resilient material, the third annular conductor being exposed therefrom.

4. The electrical contact system of claim 1 wherein the first and second resilient materials having dielectric characteristics and dimensions adjusted to provide a desired impedance to the first and second electrical contacts.

5. The electrical contact system of claim 4, wherein both of the first and second housings are sprung with respect to a mating surfaces of the tool joints, thereby providing a biasing effect to the first and second electrical contacts.

6. The electrical contact system of claim 4, wherein the first and second electrical contacts are further configured to be pressed together by pressure encountered in a downhole environment.

7. The electrical contact system of claim 4, wherein at least one of the first and second electrical contacts is configured to orbit with respect to a mating surface of a downhole tool.

8. The electrical contact system of claim 1, wherein the first and second resilient materials comprise at least one material selected from the group consisting of silicone, Vamac, polysulfide, Neoprene, Hypalon, butyl, Teflon, millable polyurethane, cast polyurethane, rubber, fluorosilicone, epichlorohydrin, nitrile, styrene butadiene, Kalrez, fluorocarbon, Chemraz, and Aflas.

9. The electrical contact system of claim 8, wherein the first and second resilient materials further comprise at least one modifier to strengthen the resilient material.

10. The electrical contact system of claim 1, wherein a cable is electrically connected to at lent one of the first and second electrical contacts, and wherein the impedance of the at least one electrical contact is adjusted to match the impedance of the cable.

11. The electrical contact system of claim 10, wherein the cable is a coaxial cable.

12. An electrical contact system for transmitting information across tool joints in a drill string, the electrical contact system comprising:

a first electrical contact comprising:

a first annular resilient material;

a first annular conductor embedded within the first annular resilient material, the first annular conductor having a surface exposed from the first annular resilient material; and a first annular housing forming an open channel accommodating the first annular resilient material and the first annular conductor and disposed within a recess at an end of te tool joint;

the first housing having an angled surface interacting with a corresponding angled surface in the recess to exert a force urging the first contact outward from the recess;

a second electrical contact having a second annular resilient material, a second annular conductor embedded in the resilient material, and a second annular housing forming an open channel to accommodate te second resilient material;

the second contact mounted in a mating end of a second tool joint;

the first electrical contact configured to contact the second electrical contact such that the first and second annular conductors come into physical contact; and the first and second resilient materials further providing a biasing effect keeping the first and second annular conductors pressed together;

wherein, upon assemble of the tool joints, the first and second contacts connect and are held engaged by the force and the biasing effect.

13. The electrical contact system of claim 12, wherein both of the first and second annular housings are sprung with respect to a mating surface of a downhole tool, thereby providing a biasing effect to the first and second electrical contacts.

14. The electrical contact system of claim 12, wherein the first and second electrical contacts are further configured to be pressed together by pressure encountered in a downhole environment.

15. The electrical contact system of claim 12, wherein at least one of the first and second electrical contacts is configured to orbit with respect to a mating surface of a downhole tool.

16. The electrical contact system of claim 12, wherein the resilient material is selected such that it flows into voids within the first and second electrical contacts.

17. The electrical contact system of claim 14, wherein a cable is electrically connected to at least one of the first and second electrical contracts, and wherein the impedance of the at least one electrical contact is adjusted to match the impedance of the cable.

18. A method for transmitting information across tool joints in a drill string while minimizing signal reflections occurring at the tool joints, the method comprising:

providing a first electrical contact comprising:

a first annular resilient material; and a first annular conductor embedded within the first annular resilient material, the first annular conductor having a surface exposed from the first annular resilient material;

providing a first annular housing forming an open channel accommodating the first annular resilient material and the first annular conductor and disposed within a recess at an end of the tool joint; the first housing having an angled surface interacting with a corresponding angled surface in the recess to exert a force urging the first contact outward from the recess;

providing a second electrical contact substantially equal to the first electrical contact, the second electrical contact having a second annular resilient material and a second annular conductor;

adjusting at least one of the dielectric characteristics and the dimensions of the first and second resilient materials to provide a desired impedance to the first and second electrical contacts.

19. The method of claim 18, further providing a second annular housing to the first and second electrical contact to accommodate the first and second annular resilient material materials, and the first and second annular conductor.

20. The method of claim 19, further comprising urging the first electrical contact against the second electrical contact.

21. The method of claim 18, wherein adjusting further comprises adjusting the impedance to match the impedance of a cable electrically connected to at least one of the first and second electrical contracts.

22. The method of claim 21, wherein the cable is a coaxial cable.

* * * * *